United States Patent [19]

Robinet

[11] 4,027,156

[45] May 31, 1977

[54] X-RAY SOURCE SAFETY SHUTTER

[75] Inventor: McLouis Robinet, Oak Park, Ill.

[73] Assignee: The United States of America as represented by the United States Energy Research and Development Administration, Washington, D.C.

[22] Filed: May 25, 1976

[21] Appl. No.: 689,890

[52] U.S. Cl. ..... 250/275; 250/414; 250/514

[51] Int. Cl.[2] ..... G21F 5/04; H01J 35/16

[58] Field of Search ..... 250/513, 514, 498, 272, 250/275, 414

[56] References Cited

UNITED STATES PATENTS 3,721,826 3/1973 Thomas, Jr. ..... 250/514

*Primary Examiner*—Paul L. Gensler
*Assistant Examiner*—T. N. Grigsby
*Attorney, Agent, or Firm*—Dean E. Carlson; Arthur A. Churm; Paul A. Gottlieb

[57] ABSTRACT

An apparatus is provided for controlling the activation of a high energy radiation source having a shutter. The apparatus includes magnets and magnetically responsive switches appropriately placed and interconnected so that only with the shutter and other parts of the source in proper position can safe emission of radiation out an open shutter occur.

5 Claims, 2 Drawing Figures

X-RAY POWER SOURCE
30
TRACK MAGNET
27
31
25
40
19
+
44
SHUTTER MAGNET
21
-
TRACK MAGNET
31
40
25
37
MAGNET
39
44
19
21
SHUTTER MAGNET

X-RAY SOURCE SAFETY SHUTTER

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

The use of X-ray source or other high energy radiation source test equipment may be dangerous. New safety regulations attempt to prevent personal exposure to such dangerous radiation which may be caused by inadvertent, improper, or mischievous opening of shutters which cover the radiation source beam ports. For example, in X-ray diffraction equipment the shutters are spaced about the X-ray source and, while some shutters may be opened while radiation is being generated by the source, it is desirable to prevent other shutters from being opened while radiation is being generated without the proper test equipment positioned to protect the user.

Prior art safety shuttering devices suffer from their cumbersome design, which greatly increases the cost of the device. Further, many of the safety shuttering apparatus, such as U.S. Pat. No. 3,721,826 of Thomas, describe apparatus which is not readily adaptable to existing high energy radiation sources. Thus, to convert such existing sources into safe operating devices is not feasible with most prior art apparatus.

It is therefore an object of this invention to provide a safety shutter for a high energy radiation source.

Another object of this invention is to provide a safety shutter adaptable to state of the art, high energy radiation sources.

SUMMARY OF THE INVENTION

A safety device is provided for controlling activation of a high energy radiation source having a shuttering mechanism for controlling distribution of the radiation. It includes a magnet mounted on the shutter, and a magnetically responsive switch mounted on the housing of the source and which is positioned so that when the shutter is closed the magnet causes the switch to close. With the shutter open the switch is open. Additional magnet switch combinations are mounted on other parts of the apparatus so that when all parts are in appropriate positions circuitry is provided which is responsive to the condition of the switches so that only when these parts are in their appropriate positions will the radiation source be permitted to be activated.

DETAILED DESCRIPTION OF THE PREFERRED EMBODIMENT

Figure 1:
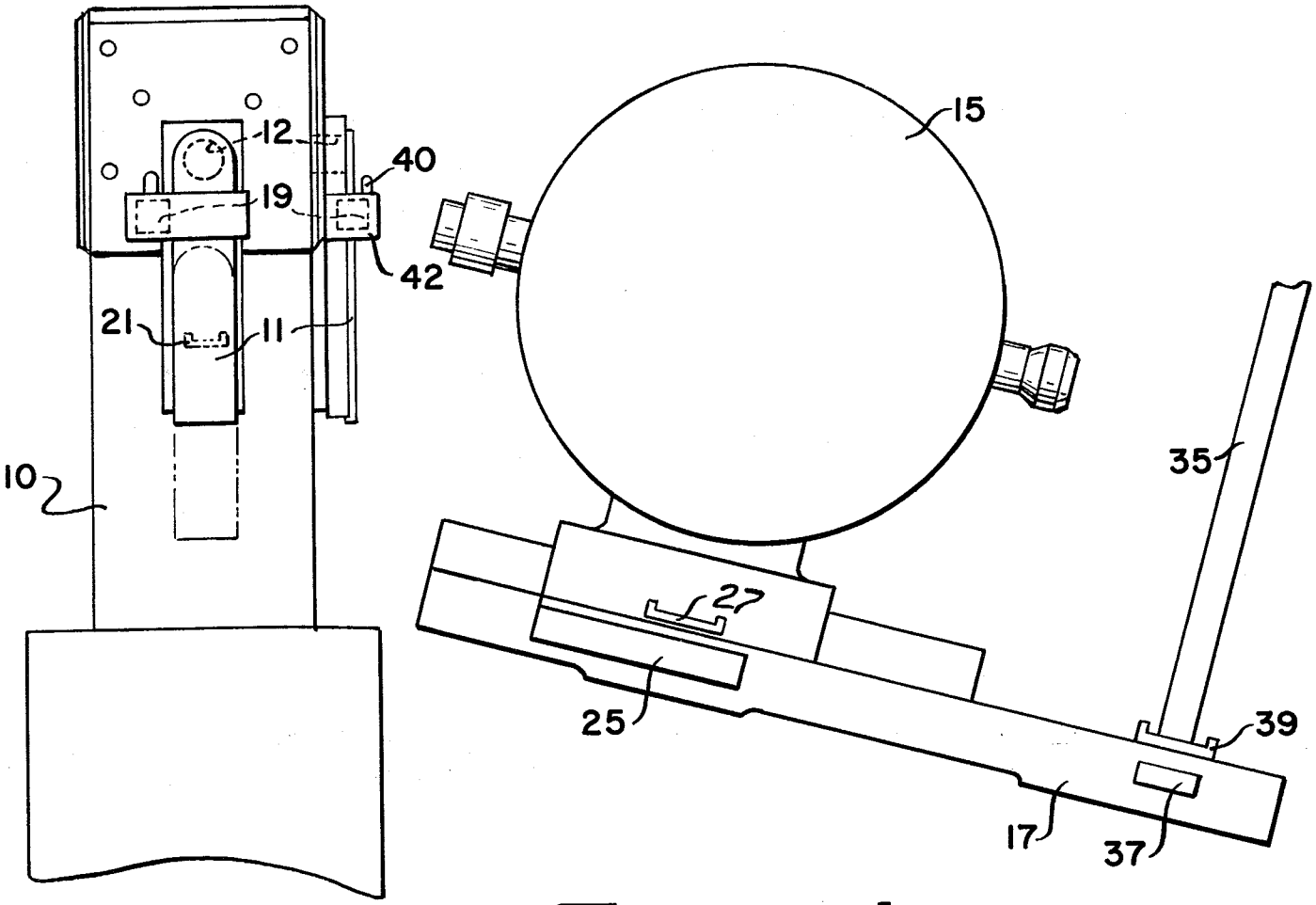
FIG. 1 shows a radiation source and shutter combination with the safety device for controlling activation of the X-ray source.

Referring to FIG. 1, there is shown a high energy radiation source provided with safety shuttering. The source of radiation such as an X-ray source, is contained within housing 10, which is normally covered by shutters 11 to prevent the undesired emission of radiation outside of housing 10. The shutters 11 are movable, having at least two positions. In one position illustrated by the solid lines of FIG. 1, each shutter 11 is in the closed position, obstructing the exit of any radiation from the associated beam port 12 of housing 10. In the other position, illustrated by the phantom lines in FIG. 1, each shutter 11 is in the open position allowing for the emission of X-rays out the associated port. For the protection of users of the radiation source, it is necessary to insure that with a shutter 11 in the open position the source can generate radiation only with certain other apparatus such as a beam receptacle properly positioned to receive the radiation from the open port. The requirement for proper positioning of certain apparatus prevents the dispersal of the high energy radiation to any but desired points. For example, in an X-ray diffractometer there is generally provided as shown in FIG. 1 a beam receptacle such as camera 15 which is intended to receive X-rays from a source within housing 10 and to record the reaction of the X-rays with particular test specimens within the camera. For purposes of safety the X-ray source should not be permitted to emit X-rays with any shutter 11 open unless a camera 15 is in the proper position to receive the rays from the X-ray source passing through the open shutter. To allow movement of camera 15 between the safe X-ray receiving position and the servicing position, is mounted on track 17. When the camera is moved along track 17 to a desired position with the shutter open, then the X-ray source should be permitted to generate radiation because the danger of unsafe emission of X-rays is alleviated.

Safe operation of the shutter X-ray source combination is achieved by the interaction between magnetically responsive switches and sources of magnetic flux. A magnetically responsive switch is one which has two states, one state being in response to a particular magnetic flux and the other state being in response to the absence of a magnetic flux. Examples of magnetically responsive switches are reed switches and axiomagnetic switches, for both of which the two states are conducting or nonconducting. In the embodiment shown in FIG. 1 a magnet 21 is mounted on a shutter 11 and a magnetically responsive switch 19 is mounted on housing 10. Another magnetically responsive switch 25 is located along track 17 in the position at which a suitable beam receptacle would be properly positioned to allow for the emission from the X-ray source with the safety shutter 11 open. Another magnet 27 is mounted on the beam receptacle camera 15. Assume switches 19 and 25 are reed switches. The magnet 21 is positioned on shutter 11 and switch 19 is selected so that with shutter 11 entirely closed, magnet 21 is adjacent switch 19 causing switch 19 to be conducting, and so that with shutter 11 open, magnet 21 is so displaced from switch 19 that switch 19 is nonconducting. Similarly, magnet 27 is positioned on camera 15 and switch 25 is selected so that with shutter 11 open and camera 15 in the desired position to safely receive X-rays from the open shutter, magnet 27 is adjacent switch 25 causing switch 25 to be conducting, and so that regardless of the position of shutter 11 and with camera 15 not in the desired position to safely receive X-rays, magnet 27 is sufficiently displaced from switch 25 that switch 25 is nonconducting. Note that the position of the switches and magnets could be reversed, i.e. the switch mounted on the shutter and the magnet mounted on the housing. Further the switches could have opposite states for allowing activation. Such combinations would be obvious to those skilled in the art based upon this disclosure.

Figure 2:
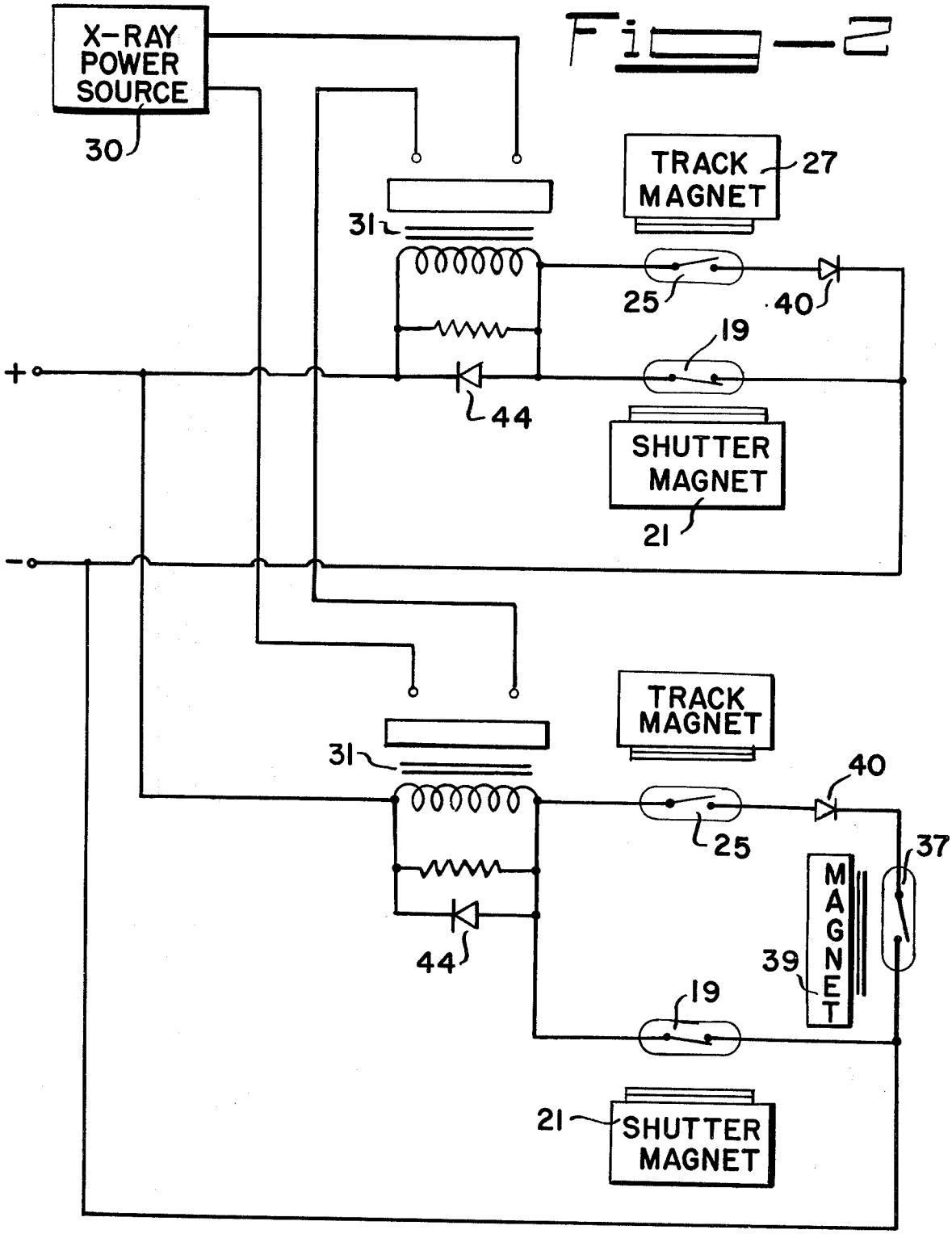
FIG. 2 shows the safety circuit for controlling activation of the source.

Referring to FIG. 2, there is shown the circuitry (not shown in FIG. 1) by which the switches 19 and 25 are coupled to the X-ray source to control the operation thereof. The switch 25 and the switch 19 are coupled in parallel. The X-ray power source 30, which controls the generation of X-rays, is coupled to this parallel coupling via relay coil 31 and is responsive thereto so that only with either switch closed will there be a completed circuit to allow for the generation of the X-rays by the source within housing 10. Therefore, either shutter switch 19 or track switch 25 must be closed to have X-rays exit from port 12, which corresponds to the condition whereby either the shutter 11 is closed or camera 15 is in the proper position to allow X-rays to exit the open shutter.

In FIG. 1, there is shown only one utilization of a beam port 12 with a beam receptacle, however, there is virtually no limit to the number of combination of shutters and beam receptacles that could be used. Normally such X-ray sources have four beam ports. Therefore, there could be four sets of switches each of which is capable of controlling the operation of X-ray source 30. This is shown in FIG. 2 where for purposes of illustration there is diagramed circuitry for two beam ports with the two arrangements in series with each other. Thus, there is a second combination of switches 19 and 25, magnets 21 and 27, and relay 31. Note that the circuitry permits X-rays to be generated when one or more shutters 11 are closed. This is because one shutter 11 may be open with a beam receptacle properly positioned so that in order to allow for operation of the X-ray source, each switch 19 associated with a closed shutter 11 is conducting. Further refinements to FIG. 2 include a light emitting diode 40 in series with track switch 25 serving to indicate that the shutter 11 is open and that X-rays are on. If the diode fails, the switch 25 cannot turn the X-ray source 30 on. In addition, the switches are magnetically shielded by shield 42 to eliminate extraneous switch closers and to more accurately define the open-closed range of the switch relative to the position of the beam receptacle. A diode 44 is in parallel with relay coil 31 and prevents possible arcing across open circuits of 25 and 19.

Referring to FIG. 2, there is shown a natural extension of the circuit by requiring that a number of devices in addition to the beam receptacle be properly positioned before the X-rays are allowed to be safely emitted through an open shutter 11. For example, if it would also be required that a device such as a shield 35 be positioned in an appropriate location, such shield 35 would be provided with a switch 37-magnet 39 combination. This combination would require that the shield 35 be properly positioned along with camera 15 being properly positioned before the X-rays would be allowed to be emitted. As shown in FIG. 2, switch 37 is coupled in series with switch 25, so that only when both switches are closed, i.e. only when the camera 15 and the shield 35 are properly positioned, will there be a completed circuit allowing for the operation of X-ray source 30. This series connection concept could be extended to any number of things which would be required to be properly positioned.

The precise positioning of the elements before the switches assume the responsive state is controlled by the selection of the size magnet and size magnetic switches that are used. Thus, a great range of accuracy can be obtained in the positioning of the device depending upon the particular selection of circuit elements. A particular advantage of this device is that it is easily adapted to existing safety shutter systems allowing them to comply with new radiation safety standards for X-ray diffraction analysis equipment without cumbersome refitting. The device is easily attached and easily removed requiring only a simple jack. Other prior art shutter systems require numerous screw couplings to the X-ray source housing. There are no precision moving parts in the arrangement. The requirement for a magnet properly located on each beam receptacle discourages the use of unauthorized or makeshift accessories in place of the proper receptacle.

The embodiments of the invention in which an exclusive property or privilege is claimed are defined as follows:

1. In a high energy radiation source enclosed in a housing and having a shutter mounted on said housing, and a beam receptacle, a safety device for controlling the activation of the source, comprising:

first and second magnet elements, first and second mangetically responsive switch elements, each switch element being responsive to a magnet element being adjacent thereto to assume a first state and each being responsive to a magnetic element being displaced therefrom to assume a second state, one of said first elements being mounted on said housing and the other of said first elements being mounted on said shutter such that with the shutter closed said first switch element assumes said first state and with the shutter open said first switch element assumes said second state, one of said second elements being mounted on the receptacle and the other of said second elements being positioned such that with the receptacle in a desired location for safe activation of the source with the shutter open said second switch element assumes said first state and with the receptacle displaced from said desired location said second switch element assumes said second state, and relay means coupled to the source and having coupled in parallel thereacross said first and second switch elements, said relay means being responsive to either of said switch elements being in said first state to allow activation of the source.

2. The device of claim 1 further including a third magnet element, a third magnetically responsive switch element, and an apparatus which is required to be in a particular location at the same time as the receptacle is in said desired location before activation of the source can safely occur, one of said third elements being mounted on said apparatus and the other of said third elements being positioned such that with said apparatus at said particular location said third switch element assumes said first state and with said apparatus displaced from said particular position said third switch element assumes said second state, said third switch element being coupled in series with said second switch element and said second and third switch elements being coupled in parallel with said first switch element, said relay means being responsive thereto to allow activation of the source with both second and third switch elements in said first state.

3. The device of claim 1 wherein the source includes a plurality of shutters, and wherein there is further included a plurality of first and second magnet elements, first and second magnetically responsive switch elements, and beam receptacles, each of said shutters having mounted thereon and associated therewith one of said first elements and associated with and adjacent each of said shutters said housing having mounted thereon the other of said first elements such that with a shutter closed the first switch element associated therewith assumes said first state and with a shutter open said first switch element associated therewith assumes said second state, each beam receptacle having mounted thereon and associated therewith one of said second elements and associated with and positioned desirably with respect to each receptacle is the other of said second elements such that with a receptacle in a desired location to safely receive radiation through an open shutter said second switch element associated therewith assumes said first state and with a receptacle displaced from said desired location said second switch element associated therewith assumes said second state, and a plurality of relay means coupled to said source, each of said relay means having coupled in parallel thereacross said first and switch elements, each of said relay means being responsive to both of said switch elements coupled thereto assuming said second state to prevent activation of the source.

4. The device of claim 3 wherein said energy radiation source is an X-ray diffraction machine.

5. The device of claim 4 wherein said receptacles are beam cameras.

* * * * *